US012146283B2

(12) United States Patent
Nielsen

(10) Patent No.: US 12,146,283 B2
(45) Date of Patent: Nov. 19, 2024

(54) GARBAGE COLLECTION APPARATUS

(71) Applicant: ALL IN ON GREEN APS, Viborg (DK)

(72) Inventor: Mads Tranders Nielsen, Viborg (DK)

(73) Assignee: ALL IN ON GREEN APS, Viborg (DK)

( * ) Notice: Subject to any disclaimer, the term of this patent is extended or adjusted under 35 U.S.C. 154(b) by 50 days.

(21) Appl. No.: 17/796,373

(22) PCT Filed: Jan. 21, 2021

(86) PCT No.: PCT/DK2021/050020
§ 371 (c)(1),
(2) Date: Jul. 29, 2022

(87) PCT Pub. No.: WO2021/151441
PCT Pub. Date: Aug. 5, 2021

(65) Prior Publication Data

US 2023/0143559 A1 May 11, 2023

(30) Foreign Application Priority Data

Jan. 29, 2020 (DK) ..... PA 2020 70057

(51) Int. Cl.
*E02B 15/10* (2006.01)
*E02B 15/08* (2006.01)

(52) U.S. Cl.
CPC ..... *E02B 15/104* (2013.01); *E02B 15/0835* (2013.01); *E02B 15/0857* (2013.01)

(58) Field of Classification Search
CPC ..... E02B 5/085; E02B 15/04; E02B 15/08; E02B 15/0835; E02B 15/104
(Continued)

(56) References Cited

U.S. PATENT DOCUMENTS 4,610,635 A * 9/1986 Austevoll ..... B63B 27/36 405/60
6,117,336 A * 9/2000 Sachse ..... E03F 5/14 210/776

(Continued)

FOREIGN PATENT DOCUMENTS

BE 1026721 A1 * 5/2020
CN 203951831 U 11/2014

(Continued)

OTHER PUBLICATIONS

Search Report for Danish Patent App. No. PA 2020 70057 (May 5, 2020).

(Continued)

*Primary Examiner* — Frederick L Lagman
(74) *Attorney, Agent, or Firm* — Cermak & McGowan LLP; James Creighton Wray; Malcolm K. McGowan

(57) ABSTRACT

Garbage collection apparatus for the collection of plastic from a surface of a waterbody with a waterflow. The garbage collection apparatus comprises a base and a horizontal beam mounted pivotably around a vertical axis on the base. Said horizontal beam is mounted displaceably in vertical direction on the base, where said horizontal beam on an underside comprises a collection device for collecting plastic floating on the surface of the waterbody. The collection device extends vertically away from the horizontal beam and extends horizontally in a direction opposite the direction of the water flow in the waterbody, which collection device comprises one of either bars or mesh, where said garbage collection apparatus comprises a first actuator for displacing the horizontal beam in or into vertical direction and where said collection device is connected rotatably to the horizontal beam and where the rotation axis of the collection device relative to the beam is parallel to a main axis of the horizontal beam and where the garbage collection apparatus (Continued)

comprises a controller. Method for removing plastic from the surface of a waterbody with a water flow, with a garbage collection apparatus.

11 Claims, 7 Drawing Sheets

(58) Field of Classification Search
USPC ..... 405/60, 66, 71
See application file for complete search history.

(56) References Cited

U.S. PATENT DOCUMENTS

| | | | | |
|---|---|---|---|---|
| 6,729,798 | B2 * | 5/2004 | Coe | E02B 3/02 405/63 |
| 6,860,677 | B2 * | 3/2005 | Johnston | E02B 8/023 405/71 |
| 10,323,375 | B1 * | 6/2019 | Bates, Jr. | E02B 15/0835 |
| 2010/0025314 | A1 * | 2/2010 | Cheng | E02B 15/08 210/170.05 |
| 2011/0198302 | A1 * | 8/2011 | Griffith | E02B 15/0814 210/776 |

FOREIGN PATENT DOCUMENTS

| | | | | |
|---|---|---|---|---|
| CN | 106592552 | A | | 4/2017 |
| CN | 107354922 | A | | 11/2017 |
| CN | 107964927 | A | | 4/2018 |
| CN | 207862899 | | * | 9/2018 |
| CN | 207862899 | U | | 9/2018 |
| CN | 109018225 | A | | 12/2018 |
| CN | 208293546 | U | | 12/2018 |
| CN | 208870010 | U | | 5/2019 |
| CN | 114016480 | B | * | 12/2022 |
| DK | 128600 | B | | 6/1974 |
| EP | 3798364 | A1 | | 3/2021 |
| KR | 100576147 | B1 | | 5/2006 |
| KR | 101166338 | B1 | * | 7/2012 |
| KR | 20230046860 | A | * | 4/2023 |
| NO | 151886 | B | | 3/1985 |
| WO | WO2018/199357 | A1 | | 11/2018 |
| WO | WO-2019215584 | A1 | * | 11/2019 |

OTHER PUBLICATIONS

International Search Report for PCT Patent App. No. PCT/DK2021/050020 (Apr. 22, 2021).
Written Opinion for PCT Patent App. No. PCT/DK2021/050020 (Apr. 22, 2021).
Office Action from Chinese Patent App. No. 202180011946.6 (Mar. 21, 2024).

* cited by examiner

GARBAGE COLLECTION APPARATUS

This application claims the benefit of Danish Application No. PA 2020 70057 filed Jan. 29, 2022 and PCT/DK2021/050020 filed Jan. 21, 2021, International Publication No. WO 2020/038539 A2, which are hereby incorporated by reference in their entirety as if fully set forth herein.

FIELD OF THE INVENTION

The present invention relates to a garbage collection apparatus for the collection of plastic from a surface of a waterbody with water flow.

BACKGROUND OF THE INVENTION

Pollution of the environment with macroscopic plastic particles has become an increasing environmental problem. The oceans are increasingly filled with plastic particles. The Great Pacific garbage patch is estimated to be 1.6 million square kilometres with a plastic concentration of up to 100 kilograms per square kilometre in the centre and approximately 10 kilograms per square kilometre in its periphery. Clean-up of the ocean once the plastic has reached the ocean is extremely difficult and expensive.

When the plastic has been ground down to microscopic particles by ocean currents it is impossible to remove from the water and it accumulates in the food chain.

Thus there exists a need for preventing pollution of the ocean with plastic waste.

The present invention aims at providing a solution for this need, by collecting garbage in waterbodies with a water flow such as rivers and streams. In this way plastic waste is prevented from reaching the ocean. Plastic collection is thus performed cheaper and more efficiently than on the ocean and pollution is prevented.

There are known trash skimmer boats to clean plastic trash from rivers and other water bodies. There are also known floating garbage removal devices for rivers such as the one described by KR100576147B.

From CN 107354922 A is known a garbage collection apparatus for mounting on a car for cleaning small trenches.

The mentioned devices all have the common drawback that they are labour intensive to operate.

A further drawback, of the devices in the state of the art is that they do not allow for efficient and easy emptying of the collected garbage.

Finally, the device known from CN 107354922 A is only suitably for cleaning small trenches. It cannot be applied to collecting garbage from rivers.

Object of the Invention

It is an object of the invention to provide solutions for the above mentioned needs and drawbacks.

It is an object to the invention to provide a garbage collection apparatus, which can be operated efficiently with reduced labour costs and can be emptied easily and efficiently.

It is an object of the invention to provide a method for removing plastic from the surface of a waterbody which provides a solution for the above mentioned needs and drawbacks.

Description of the Invention

This is achieved by the present invention with a garbage collection apparatus for the collection of plastic and other debris from a surface of a waterbody, which garbage collection apparatus comprises a base and a beam mounted pivotally around an axis on the tower, where said beam is mounted displaceably in a vertical direction on the base, where said beam comprises an underside, a front and a back, where said beam on an underside comprises a collection device for collecting plastic floating on the surface of the waterbody, which collection device extends downwards from the beam and in use into the water, which collection device comprises bars and/or a mesh for skimming plastic and other floating debris from the surface of the waterbody, where said garbage collection apparatus comprises a first actuator for displacing the beam in or into vertical direction, where said collection device is connected pivotably to the beam and where the rotation axis of the collection device relative to the beam is parallel to a main axis of the beam, where the garbage collection apparatus comprises a controller.

A further aspect of the invention is a method for removing plastic and other debris from the surface of a waterbody, with a garbage collection apparatus according to any of claims 1 to 11, where said apparatus comprises a base and a beam mounted pivotally around an axis on the base, and said beam being displaceable in a vertical direction on the base, which method comprises any of the following steps:

- bringing the beam into an active position in which the collection device can collect plastic and other debris floating on the surface of the water,
- adjusting a height of the beam, such that the collection device mounted on the under-side of the beam is partly submerged in the waterbody, and then either
- a)—lifting the beam and rotating the beam to an emptying area over land
- rotating the collection device, such that plastic and other garbage collected in the collecting device fall out of the collection device and onto the emptying area;
- Or
- b)—activating the device on the beam, which device transports collected debris along the beam to a collection point, wherein the device is one of the following: a conveyor, vacuum means, movable brush, vibration conveyor, flushing channel, pneumatic transport conveyor, a screw conveyor.

The method can be used with any embodiment of the described garbage collection apparatus. The method can comprise any combination of the mentioned steps.

By horizontal beam is understood that the beam is in a horizontal position when the garbage collection apparatus is collecting debris from the surface of the waterbody.

The base can be a tower. The tower has the advantage that the position of the horizontal beam can be adjusted to a wider range of water levels in the waterbody.

The first actuator can be a motor with a pulley or a hoist. Alternatively the first actuator may be other actuation means such as for example a hydraulic actuator.

By upper water layer is understood a layer between the surface of the water and 60 centimetres below the surface, preferably a layer between the surface of the water and 40 centimetres below the surface, and most preferably a layer between the surface of the water and 20 centimetres below the surface.

The garbage collection apparatus can be placed on an edge of the waterbody, such as a quay or a riverbank.

Alternatively, the garbage collection apparatus can be placed surrounded by water. In this case, the base or tower may comprise a pile foundation.

The horizontal beam can be brought at an angle to the direction of the water flow in the waterbody. The preferred orientation of the horizontal beam is in a right angle to the water flow.

The horizontal beam can then be lowered into a position, where the collection device is partly submerged in the water. Plastic particles and other garbage flowing on the water surface or in an upper water layer will accumulate in the collection device.

When the collection device is full, the horizontal beam can be lifted out of the water by actuating the first actuator.

When the base is located close to land, for example at a riverbank or at a quay, the horizontal beam can be rotated over land. On land a plastic collection element such as a garbage container can be placed.

The garbage collection apparatus can comprise a second actuator for effecting a rotational motion of the beam around the vertical axis.

The second actuator can be a motor or a hydraulic actuator or other suitable actuation means.

The collection device can be rotated into an emptying position such that the plastic collected in the collection device falls out of the collection device and into the plastic collection element.

Detecting a full collection device can be performed by measuring the force exerted on the horizontal beam in a direction parallel with the surface of the waterbody. This can for example be performed by measuring the force exerted on the second actuator. Data from other sensors, such as but not limited to water flow sensors, water level sensors or wind sensors can also be taken into account for detecting a full collection device.

The "full" condition can be adapted to local conditions. For example, in fast flowing rivers it might be desirable to empty the garbage collection apparatus with a smaller amount of debris in the collection device than in slow flowing rivers.

The garbage collection apparatus can comprise scraper rods mounted on the underside of the beam. When the collection device is rotated the scraper rods loosen plastic particles which are attached to the collection device increasing the efficiency of the emptying process.

The collection device can be rotated back into a collection position. The horizontal beam is rotated back into an angle with the water flow in the waterbody. The horizontal beam is lowered into a position where the collection device is partly submerged in the waterbody and plastic collection can be continued.

The garbage collection apparatus can comprise a third actuator for effecting the rotation of the collection device.

By main axis of the horizontal beam is understood an axis parallel to the longitudinal direction of the horizontal beam.

By underside is understood the side facing the surface of the waterbody.

By front is understood the side of the horizontal beam which in use is oriented upstream of the water flow in the water body. By back of the horizontal beam is understood the side of the beam which is oriented downstream of the water flow in the water body.

The collection device covers a major part of a length of the horizontal beam.

The garbage collection apparatus can comprise sensors such as, but not limited to, water level sensors, wind sensors, temperature sensors, cameras, radar, LIDAR, force sensors.

The controller can control the first actuator. The controller can control the second actuator. The controller can control the third actuator. The controller can process data from sensors such as, but not limited to, water level sensors, wind sensors, temperature sensors, cameras, radar, LIDAR, force sensors. The controller can actuate the actuators dependent on the data received from one or more sensors.

The garbage collection apparatus can comprise a holding wire connecting the base and the horizontal beam. The holding wire is in a first end attached to the base in a part above the beam, preferably in a top area of the base. The holding wire is in a second end attached to the horizontal beam in a middle area of the beam. The holding wire increases the stability of the garbage collection apparatus. Furthermore, it allows the garbage collection apparatus to be constructed using less material and is therefore more cost effective.

The garbage collection apparatus can comprise a warning light.

In a further embodiment the garbage collection apparatus is characterised in that the collection device is substantially L-shaped in a cross-section which is orthogonal to the longitudinal direction of the horizontal beam.

In a further embodiment the garbage collection apparatus is characterised in that the garbage collection apparatus comprises a camera.

The camera can operate using visible light. Alternatively the camera can be a thermo-graphic camera. Both a camera using visible light and a thermographic camera can be used together.

Data from the camera can be used to detect objects which might collide with the garbage collection apparatus, such as boats.

When an object is detected the warning light can be activated. The horizontal beam can be lifted out of the water. The horizontal beam can be rotated to avoid collision.

In a further embodiment the garbage collection apparatus is characterised in that the beam comprises a lattice structure comprising triangles and/or tetrahedrons.

The lattice structure allows the beam to be of light weight and high durability.

In a further embodiment the garbage collection apparatus is characterised in that the base comprises an undercut recess extending along the vertical direction, which under-cut recess co-operates with a slide on a first end of the horizontal beam.

The undercut recess and the slide allow translational movement of the horizontal beam.

Alternatively, the base or tower can comprise a circular cross-section and the beam can be mounted rotatably and displaceable to the tower with a pipe formed element with diameter larger than the cross-section of the base or tower, which pipe formed element is arranged coaxially on the base or tower.

In a further embodiment the garbage collection apparatus is peculiar in that the garbage collection apparatus comprises a power storage device and a solar cell and/or a turbine for charging the power storage device.

The turbine can be a wind turbine and/or a water turbine. The technical effect achieved is that the garbage collection apparatus can be operated autonomously from the electrical grid.

In a further embodiment the garbage collection apparatus is characterised in that it comprises a first transporting device on the horizontal beam, which first transporting device transports collected debris along the longitudinal direction of the horizontal beam.

The first transporting device can transport the plastic and other debris collected in the collection device along the horizontal beam and to a garbage storage element such as a container. Preferably the garbage storage element is located on land. When the garbage collection apparatus is not located in the vicinity of land, a floating garbage storage element such as a barge can be used.

When the collection device is to be emptied, the collection device can be rotated into an offloading position by actuating the second actuator. The collection device is rotated out of the water and above the first transporting device such that the plastic collected in the collection device falls onto the first transporting device. The collection device can be rotated back into the collection position. The first transporting device can be activated and the collected plastic can be transported into the garbage storage element.

The first transporting device can be a conveyor belt. Alternatively the first transporting device can be a screw conveyor or a suction device such as a pump.

In an aspect of the garbage collection apparatus the horizontal beam may be lifted prior to activating the first transporting device. In another aspect of the invention the horizontal beam may stay in its active position in which debris is collected when the first transporting device is activated.

The garbage collection apparatus may comprise a second transporting device. The second transporting device can be located at an end of the horizontal beam. The second transporting device transports the plastic and other debris which is transported by the first transporting device to an end of the horizontal beam to the garbage storage element. The second transporting device can be a conveyor belt. Alternatively the second transporting device can be a screw conveyor or a suction device such as a pump.

In a further embodiment the garbage collection apparatus is characterised in that it comprises a water level sensor.

The water level sensor is connected to the controller. The water level sensor measures the height of the water level in the waterbody. Depending on the input of the water level sensor, the controller can actuate the first actuator and adjust a height of the horizontal beam, such that the collection device is partly submerged in the waterbody and collects plastic flowing in an upper layer of the water.

This has the advantage that there is minimal disturbance of the water flow in the upper water layer. Thus, collection of plastic is efficient.

In a further embodiment, the horizontal beam can at an underside comprise one or more floating elements, which floating elements keep the horizontal beam floating on the surface of the waterbody. Thus, during plastic collection, the horizontal beam automatically adjusts to changes in water level.

In a further embodiment the garbage collection apparatus is peculiar in that the horizontal beam is mounted pivotally around a horizontal axis to the base.

Further advantageous embodiments foresees that the device on the beam is one of the following: a conveyor, vacuum means, movable brush, vibration conveyor, flushing channel, pneumatic transport conveyor, a screw conveyor, And further embodiment wherein the apparatus comprises a number of sensors, there among one or more of the following: a water level sensor, a water current sensor, a wind load sensor, an air temperature sensor, a water temperature sensor, horizontal load on beam, vertical load on beam;

Where said sensors are connected to the controller, and where said controller comprises pre-stored operational ranges for one or more of the following: water level, water current velocity, wind velocity, air temperature, water temperature, horizontal load and vertical load, such that if the input from one or more of the sensors falls outside the corresponding operational range, the controller activates the actuators in a pre-determined manner.

In a further aspect of the invention the method can further comprise the following steps:

- detecting if the collection device is full, by analysing data from at least one sensor with the controller and comparing the measured data to predetermined values,
- emptying the collection device, if it is detected that the collection device is full.

In a further aspect of the invention the method can further comprise the following steps:

- measuring wind speed and/or wind direction by a wind sensor and compare the measured wind speed and/or wind direction to a predetermined maximum safe operating value
- bring the horizontal beam into a safe position if the measured values exceed the pre-determined maximum safe operating values.

Damage to the garbage collection apparatus by weather conditions may be prevented by bringing the horizontal beam in a safe position. The safe position may be a position on or over land. Alternatively the safe position may be a lifted positon. Alternatively the safe position may be parallel to the wind direction.

In a further aspect of the invention the method can further comprise the following steps:

- measuring the temperature with a temperature sensor
- bringing the horizontal beam in a position where the collecting device is not submerged in the water, when the temperature decreases below the freezing point of water.

Damage to the garbage collection apparatus may be avoided by preventing ice to accumulate on the collection device.

In a further aspect of the invention the method can further comprise the following steps:

- measuring the temperature with temperature sensor and comparing the measured value with a predetermined maximum temperature value
- bringing the horizontal beam in an inactive position, in which inactive position no plastic or other debris is collected.

This can avoid damage to hydraulic systems or other temperature sensitive parts, when the garbage collection apparatus is operated in hot climate zones.

DETAILED DESCRIPTION OF THE INVENTION

Figure 1:
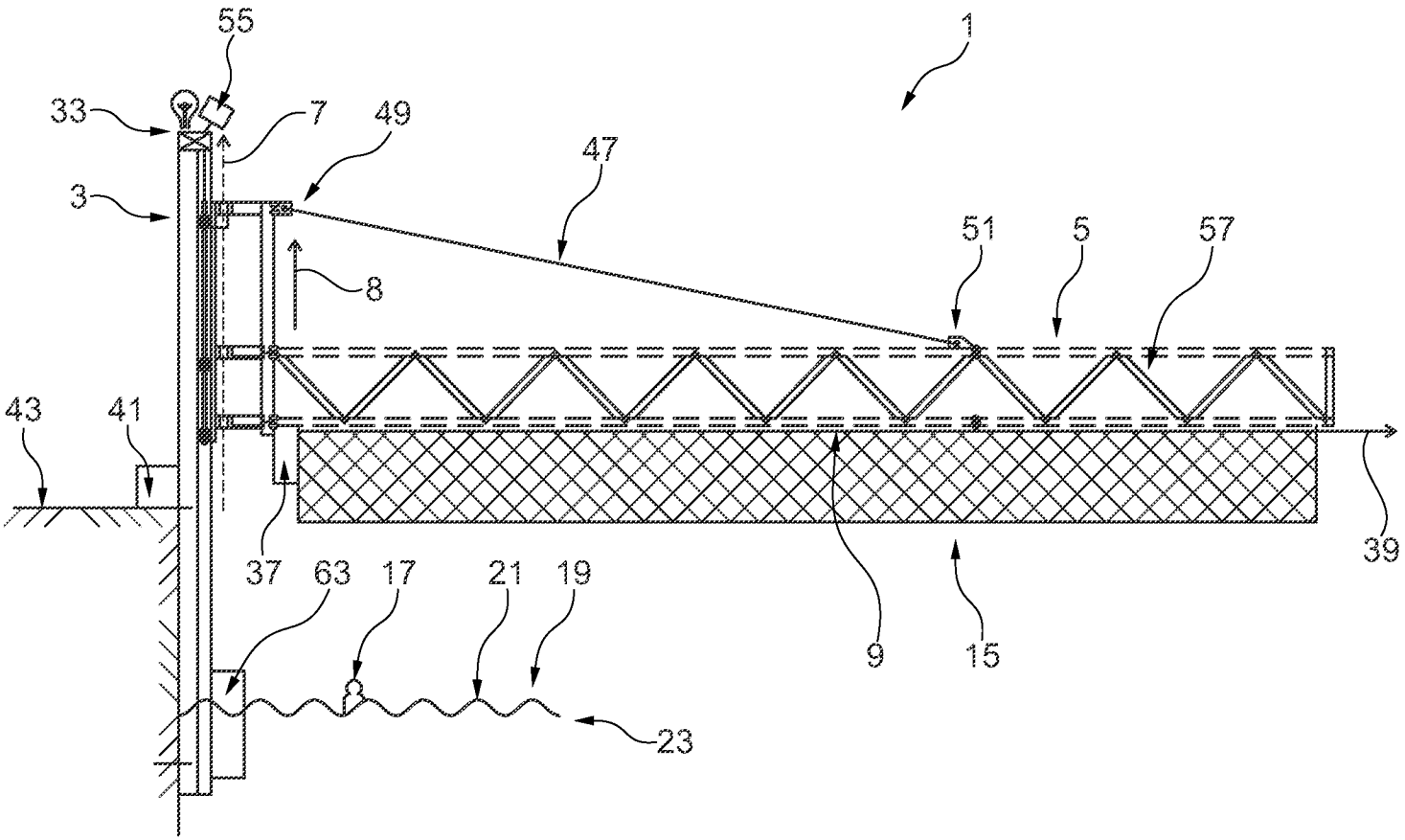
FIG. 1 shows a garbage collection apparatus according to the invention.

In the following text the figures will be described one by one, and the different parts and positions seen in the figures will be numbered with the same numbers in the different figures. Not all parts and positions indicated in a specific figure will necessarily be discussed together with that figure.

LIST OF REFERENCE NUMERALS

1 Garbage collection apparatus
3 Base/Tower
5 Horizontal beam
6 End, horizontal beam
7 Vertical axis
8 Vertical direction
9 Underside
11 Front
13 Back
15 Collection device
17 Plastic
19 Waterbody
21 Surface, waterbody
23 Upper layer, waterbody
25 Direction of water flow
27 Bars
29 Mesh
31 Scraper rods
33 First actuator
35 Second actuator
37 Third actuator
39 Rotation axis, collection device
41 Controller
43 Land
45 Garbage storage element
47 Holding wire
49 First end, holding wire
51 Second end, holding wire
53 Warning light
55 Camera
57 Lattice structure
59 Undercut recess
61 Slide
63 Waterlevel sensor
65 First transporting device
66 Second transporting device
67 Conveyor belt
69 Floating elements
71 Power storage device
73 Battery
75 Solar cell
77 Turbine FIG. 1 shows a garbage collection apparatus according to the invention from a front side.

The garbage collection apparatus 1 comprises a base 3 and a horizontal beam 5 mounted pivotally around a vertical axis 7 on the base 3. The base is a tower. The horizontal beam 5 is mounted displaceable in a vertical direction on the base 3. The horizontal beam comprises an underside 9, a front 11 and a back 13.

The horizontal beam comprises a lattice structure 57 comprising triangles. Alternatively the lattice structure can comprise tetrahedrons. The lattice structure allows the beam to be of light weight and high durability.

On the underside 9 the horizontal beam 5 comprises a collection device 15 for collecting plastic 17 floating on the surface 21 of the waterbody 19.

The collection device 15 covers the length of the horizontal beam.

The collection device 15 extends vertically away from the horizontal beam 7 and extends downwards from the horizontal beam and in use into the water 19. The collection device 15 comprises a mesh 29.

Alternatively the collection device can comprise bars 27.

The garbage collection apparatus 1 comprises a first actuator 33 for displacing the horizontal beam 5 in or into vertical direction 8, where said collection device is connected rotatably to the horizontal beam 5 and where the rotation axis 39 is parallel with a main axis of the horizontal beam.

The first actuator 33 is a motor with a hoist.

The garbage collection apparatus 1 comprises a controller 41.

The controller can control the first actuator. The controller can control the second actuator. The controller can control the third actuator. The controller can process data from sensors such as, but not limited to, water level sensors, cameras, radar, LIDAR, force sensors. The controller can actuate the actuators dependent on the data received from one or more sensors.

The garbage collection apparatus 1 comprises a holding wire 47 connecting the tower 3 and the horizontal beam 5. The holding wire 47 is in a first end 49 attached to the tower in a part above the beam, preferably in a top area of the tower. The holding wire is in a second end 51 attached to the horizontal beam in a middle area of the beam.

The holding wire increases the stability of the garbage collection apparatus. Furthermore, it allows the garbage collection apparatus to be constructed using less material and is therefore more cost effective.

The garbage collection apparatus 1 comprises a warning light 53.

The garbage collection apparatus 1 comprises a camera 55.

Data from the camera can be used to detect objects which might collide with the garbage collection apparatus, such as boats.

When an object is detected the warning light 53 can be activated. The horizontal beam 5 can be lifted out of the water. The horizontal beam can be rotated to avoid collision.

The garbage collection apparatus comprises a water level sensor 63.

The water level sensor is connected to the controller 41. The water level sensor measures the height of the water level in the waterbody 19. Depending on the input of the water level sensor, the controller can actuate the first actuator and adjust a height of the horizontal beam, such that the collection device is partly submerged in the water-body and collects plastic flowing in an upper layer of the water.

This has the advantage that there is minimal disturbance of the water flow in the upper water layer. Thus, collection of plastic is efficient.

A method for removing plastic from the surface of a waterbody with a water flow can be carried out with the garbage collection apparatus 1. The method comprises any of the following steps:

- bringing the horizontal beam into a position in an angle with the flow of the waterbody, preferably in a right angle,
- adjusting a height of the horizontal beam, such that a collection device mounted on the underside of the horizontal beam is partly submerged in the waterbody,
- lifting the horizontal beam and rotating the horizontal beam to an emptying area over land
- rotating the collection device, such that plastic and other garbage collected in the collecting device falls out of the collection device and onto the emptying area scanning the vicinity of the garbage collection apparatus with a camera and/or sensor for objects which might collide with the garbage collection apparatus initiating any one of the following actions if an object which might collide with the garbage collection apparatus is detected:

issuing a warning with a warning light and/or warning sound lifting the horizontal beam out of the water rotate the horizontal beam into a position which avoids collision.

Figure 2:
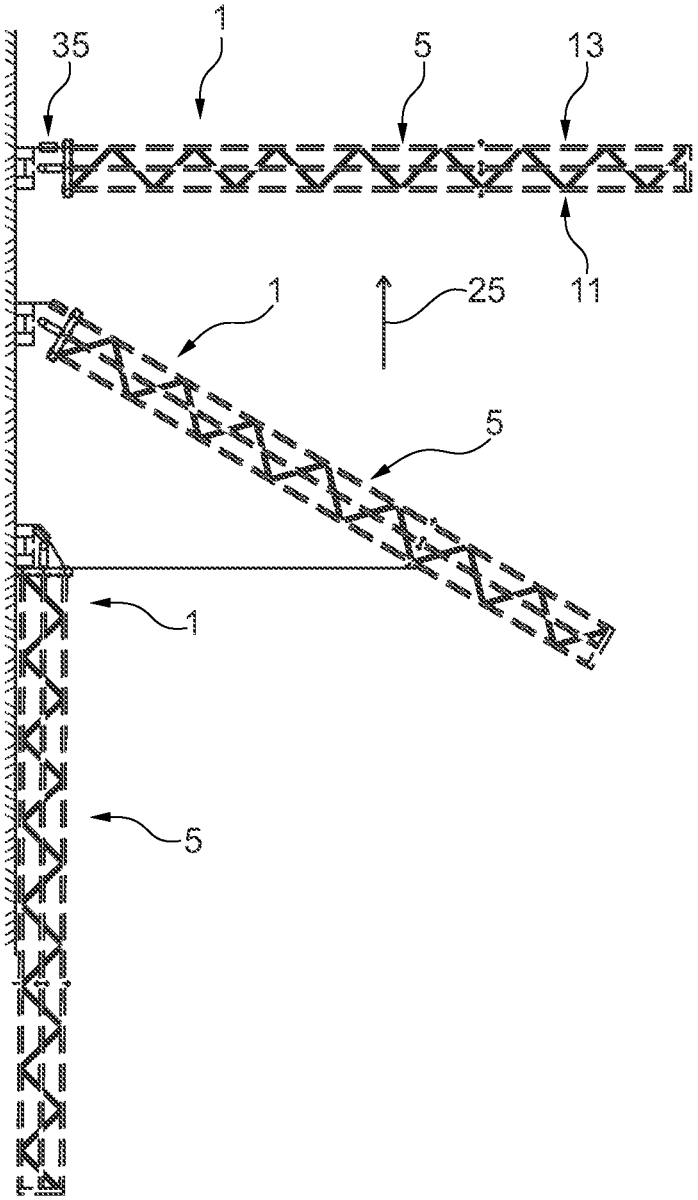
FIG. 2 shows a schematic of the plastic collection device with the horizontal beam 5 in three different positions.

FIG. 2 shows a schematic of the plastic collection device with the horizontal beam 5 in three different positions.

In a first position depicted on the top, the horizontal beam 5 is in a right angle to the direction of water flow 25.

In this position the horizontal beam can be lowered, until the collection device is partly submerged in the water. Plastic particles and other garbage flowing on the water surface or in an upper water layer will accumulate in the collection device.

When the collection device is full, the horizontal beam can be lifted out of the water by actuating the first actuator 33.

Then the horizontal beam can be rotated around a vertical axis into an emptying position.

In a second position depicted in the middle, the horizontal beam 5 is in an intermediate position at an angle to the direction of the water flow.

When the tower is located close to land, for example at a riverbank or at a quay, the horizontal beam can be rotated over or close to land. This is exemplary shown in a third position shown on the lower part of FIG. 2. On land a plastic collection element such as a garbage container can be placed.

The garbage collection apparatus comprises a second actuator 35 for effecting a rotational motion of the beam around the vertical axis.

Figure 3A:
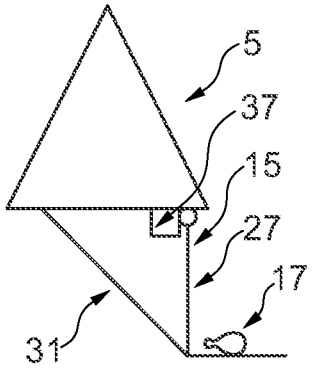
FIG. 3*a-c* show cross-sections through the horizontal beam 5 with the collection device 15 in different positions.
Figure 3B:
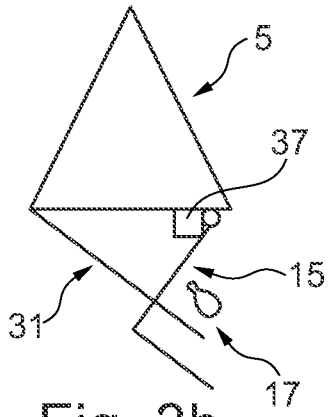
Figure 3C:
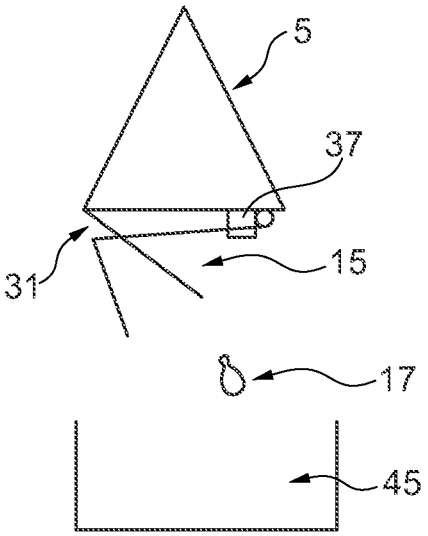

Emptying the collection device is schematically shown in FIG. 3*a-c*.

FIG. 3*a-c* show cross-sections through the horizontal beam 5 with the collection device 15 in different positions.

In FIG. 3*a* the collection device 15 is in a collection position, where carbage can be collected.

The collection device can be rotated into an emptying position such that the plastic collected in the collection device falls out of the collection device and into the garbage storage element 45.

FIG. 3*b* shows the collection device 15 in an intermediate position during rotation of the collection device.

FIG. 3*c* shows the collection device 15 in emptying position, fully rotated.

The collection device comprises bars 27.

The garbage collection apparatus comprises scraper rods 31 mounted on the underside of the beam. When the collection device is rotated the scraper rods loosen plastic particles which are attached to the collection device increasing the efficiency of the emptying process.

The collection device can be rotated back into a collection position. The horizontal beam is rotated back into an angle with the water flow in the waterbody. The horizontal beam is lowered into a position where the collection device is partly submerged in the waterbody and plastic collection can be continued.

The garbage collection apparatus comprises a third actuator 37 for effecting the rotation of the collection device.

The collection device 15 is substantially L-shaped in a cross-section which is orthogonal to the longitudinal direction of the horizontal beam 5.

Figure 4A:
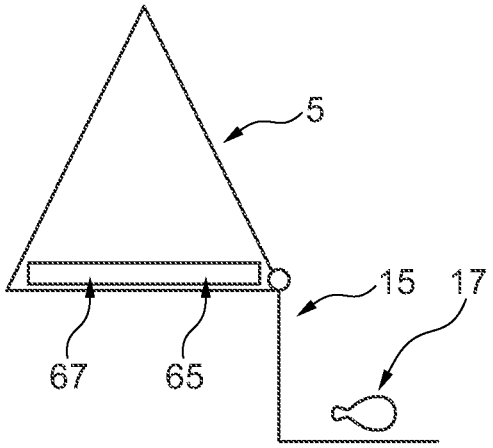
FIG. 4*a-c* show cross-sections through the horizontal beam in a further embodiment of the garbage collection apparatus.
Figure 4B:
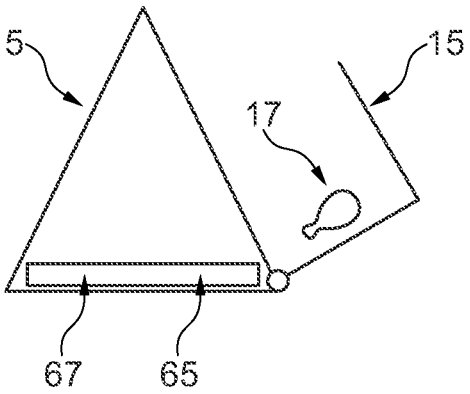
Figure 4C:
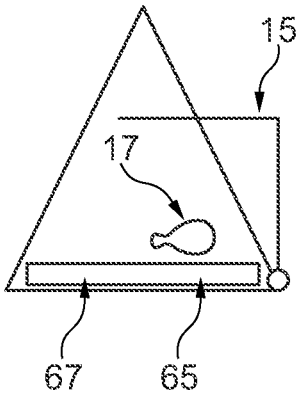

FIG. 4 shows a cross-section through the horizontal beam 5 in a further embodiment of the garbage collection apparatus 1.

The garbage collection apparatus comprises a first transporting device 65 on the horizontal beam 5.

The first transporting device 65 can transport the plastic collected in the collection device 15 along the horizontal beam and to a garbage storage element 45 such as a container.

Preferably the garbage storage element 45 is located on land. When the garbage collection apparatus is not located in the vicinity of land 43, a floating garbage storage element such as a barge can be used.

When the collection device is to be emptied, the collection device can be rotated into an offloading position by actuating the second actuator 35. The collection device is rotated out of the water and above the first transporting device 65 such that the plastic 17 collected in the collection device falls onto the first transporting device 65. The collection device can be rotated back into the collection position. The first transporting device can be activated and the collected plastic can be transported into the garbage storage element.

The first transporting device is a conveyor belt 67.

Figure 5:
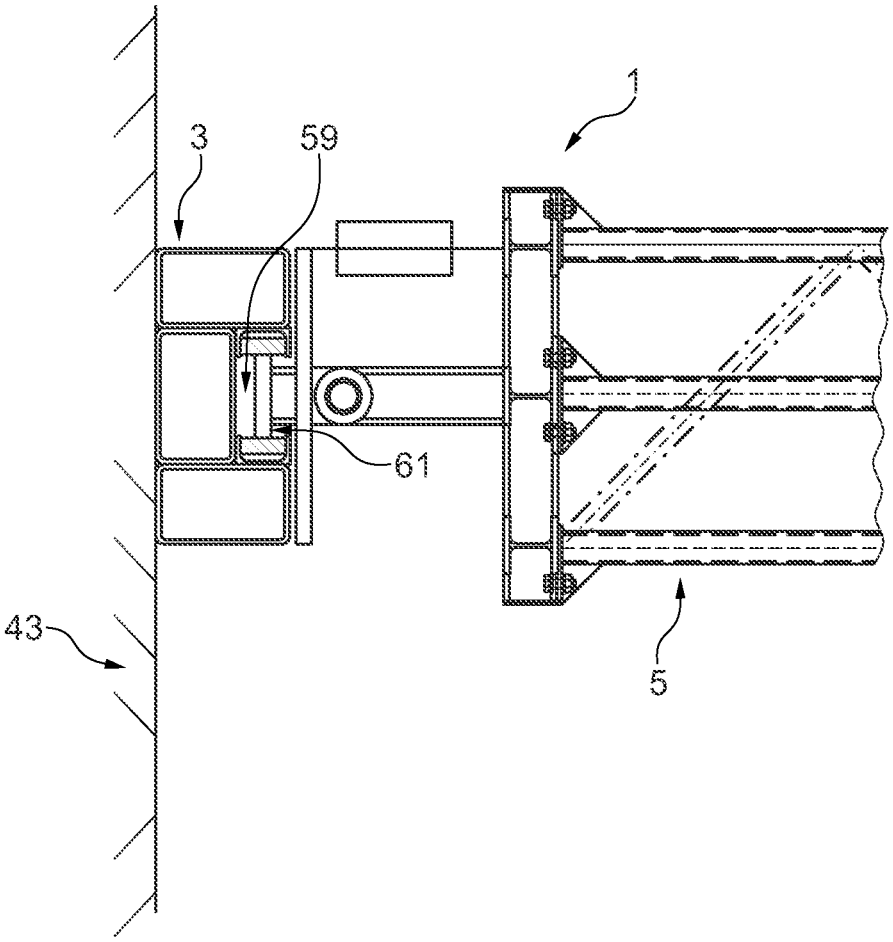
FIG. 5 shows a cross-section through the base and the horizontal beam of the garbage collection apparatus.

FIG. 5 shows a cross-section through the tower 3 and the horizontal beam 5 of the garbage collection apparatus 1. The tower 3 comprises an undercut recess 59 extending along the vertical direction, which undercut recess co-operates with a slide 61 on a first end of the horizontal beam 5.

The undercut recess 59 and the slide 61 allow translational movement of the horizontal beam.

Figure 6:
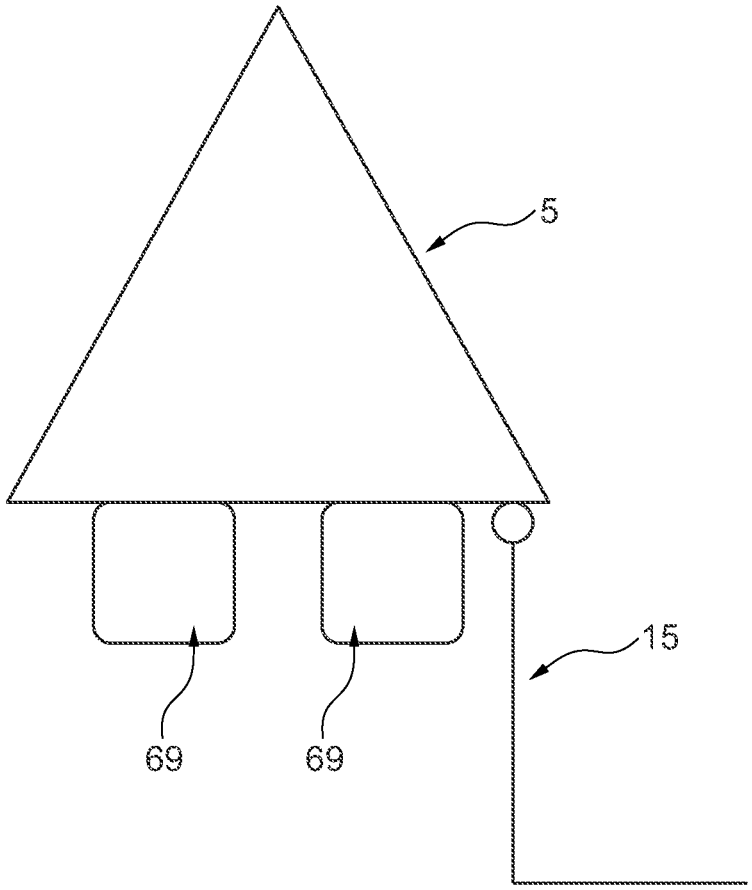
FIG. 6 shows a cross-section through the horizontal beam in a further embodiment of the plastic collection device.

FIG. 6 shows a cross-section through the horizontal beam 5 in a further embodiment of the plastic collection device 1. The horizontal beam 5 comprises at an underside 9 floating elements. The floating elements keep the horizontal beam floating on the surface of the waterbody. Thus, during plastic collection, the horizontal beam automatically adjusts to changes in water level.

Figure 7:
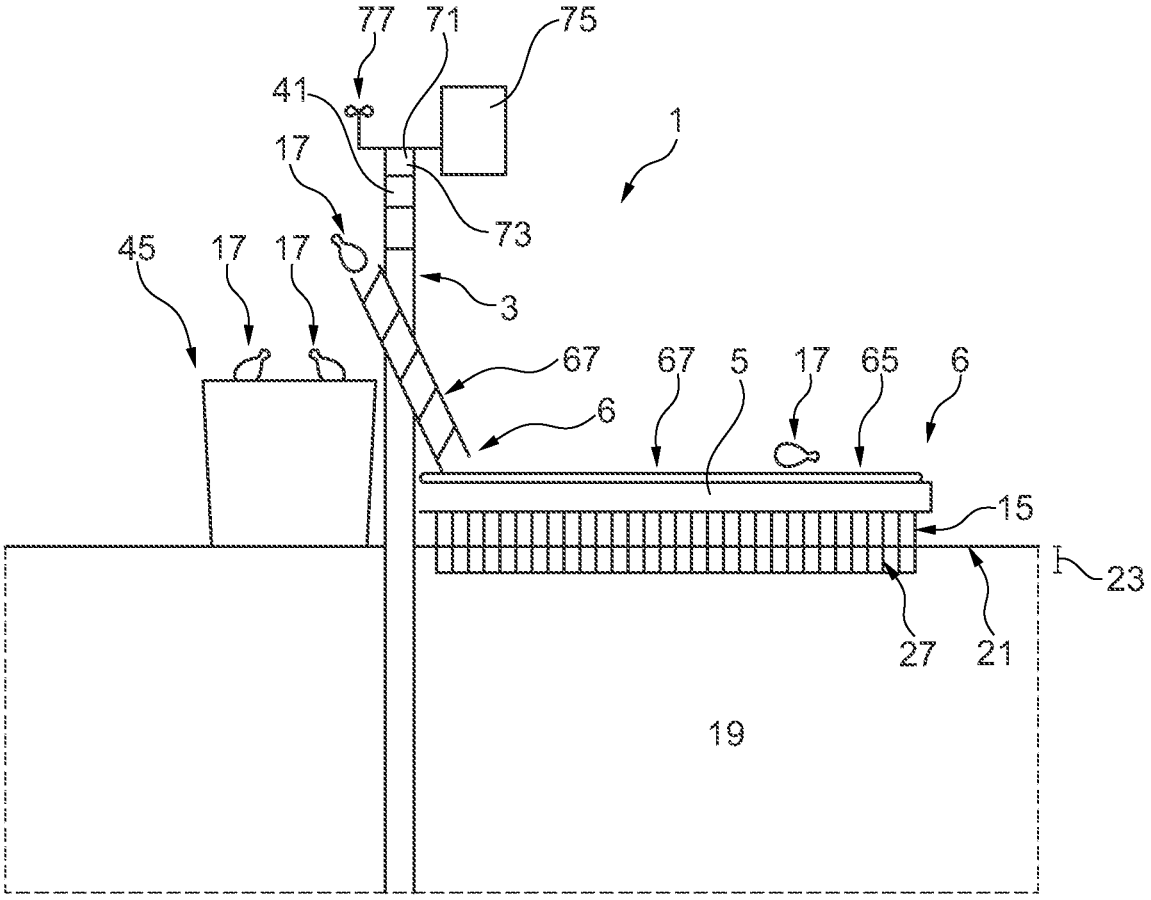
FIG. 7 shows another garbage collection apparatus.

FIG. 7 shows a garbage collection apparatus 1 comprising power storage device 71. The power storage device 71 is a battery 73. The garbage collection apparatus 1 comprises a solar cell 75 for charging the power storage device 71. The garbage collection apparatus 1 comprises a turbine 77 for charging the power storage device 1. The turbine 77 is a wind turbine. Alternatively the turbine can be a water turbine.

The garbage collection apparatus 1 comprises a second transporting device 66. The second transporting device 66 is located at an end of the horizontal beam 5. The second transporting device transports the plastic and other debris which is transported by the first transporting device to an end of the horizontal beam to the garbage storage element.

The invention claimed is:

1. Garbage collection apparatus for the collection of plastic and other debris from a surface of a waterbody, which garbage collection apparatus comprises a base and a beam mounted pivotally around an axis on a tower, where said beam is mounted displaceably in a vertical direction on the base, where said beam comprises an underside, a front and a back, where said beam on an underside comprises a collection device for collecting plastic floating on the surface of the waterbody, which collection device extends downwards from the beam and in use into the water, which collection device comprises bars and/or a mesh for skimming plastic and other floating debris from the surface of the waterbody, where said garbage collection apparatus comprises a first actuator displacing the beam in or into vertical direction, where said collection device is connected pivotably to the beam and where a rotation axis of the collection device relative to the beam is parallel to a main axis of the beam, wherein said main axis is parallel to the longitudinal direction of the horizontal beam; where the garbage collection apparatus comprises a controller; and wherein the garbage collection apparatus further comprises a device on the beam, which device transports collected debris along the beam to a collection point.

2. Garbage collection apparatus according to claim 1, characterised in that the garbage collection apparatus comprises a second actuator for effecting a rotational motion of the beam around a vertical axis.

3. Garbage collection apparatus according to claim 1, characterised in that the collection device is substantially L-shaped in a cross-section which is orthogonal to a longitudinal direction of the beam.

4. Garbage collection apparatus according to claim 1, characterised in that the garbage collection apparatus comprises a camera.

5. Garbage collection apparatus according to claim 1, characterised in that the beam comprises a lattice structure comprising triangles and/or tetrahedrons.

6. Garbage collection apparatus according to claim 1, characterised in that the garbage collection apparatus comprises a power storage device and a solar cell and/or a turbine for charging the power storage device.

7. Garbage collection apparatus according to claim 1, characterised in that the device is one of the following: a conveyor, vacuum means, movable brush, vibration conveyor, flushing channel, pneumatic transport conveyor, a screw conveyor.

8. Garbage collection apparatus according to claim 1, characterised in that the apparatus comprises a number of sensors, there among one or more of the following:

a water level sensor, a water current sensor, a wind load sensor, an air temperature sensor, a water temperature sensor, horizontal load on beam, vertical load on beam;

where said sensors are connected to the controller, and where said controller comprises pre-stored operational ranges for one or more of the following: water level, water current velocity, wind velocity, air temperature, water temperature, horizontal load and vertical load, such that if the input from one or more of the sensors falls outside the corresponding operational range, the controller activates the actuators in a pro-determined manner.

9. Garbage collection apparatus according to claim 1, characterised in that the beam at an underside comprises one or more floating elements, which floating elements keep the beam floating on the surface of the waterbody.

10. Method for removing plastic and other debris from the surface of a waterbody, with a garbage collection apparatus according to claim 1, where said apparatus comprises a base and a beam mounted pivotally around an axis on the base, and said beam being displaceable in a vertical direction on the base, which method comprises one or more of the following steps:

bringing the beam into an active position in which the collection device can collect plastic and other debris floating on the surface of the water, adjusting a height of the beam, such that the collection device mounted on the underside of the beam is partly submerged in the waterbody, and then either a)—lifting the beam and rotating the beam to an emptying area over land rotating the collection device, such that plastic and other garbage collected in the collecting device fall out of the collection device and onto the emptying area;

or b) activating the device on the beam, which device transports collected debris along die beam to a collection point, wherein the device is one of the following: a conveyor, vacuum means, movable brush, vibration conveyor, Hushing channel, pneumatic transport conveyor, a screw conveyor.

11. Method according to claim 10, where the apparatus further comprises a vison system and scanning the vicinity of the garbage collection apparatus with said vison system or camera and/or sensor for objects which might collide with the garbage collection apparatus;

initiating any one of the following actions if an object which might collide with the garbage collection apparatus is detected:

issuing a warning with a warning light and/or warning sound;

lifting the beam out of the water; or rotating the beam into a position which avoids collision.

* * * * *